US007591327B2

(12) United States Patent
Hall et al.

(10) Patent No.: US 7,591,327 B2
(45) Date of Patent: Sep. 22, 2009

(54) DRILLING AT A RESONANT FREQUENCY

(76) Inventors: David R. Hall, 2185 S. Larsen Pkwy., Provo, UT (US) 84606; John Balley, 2185 S. Larsen Pkwy., Provo, UT (US) 84606; Matt Kudla, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 205 days.

(21) Appl. No.: 11/693,838

(22) Filed: Mar. 30, 2007

(65) Prior Publication Data

US 2007/0221408 A1 Sep. 27, 2007

Related U.S. Application Data

(63) Continuation-in-part of application No. 11/686,636, filed on Mar. 15, 2007, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, application No. 11/693,838, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, which is a continuation-in-part of application No. 11/306,976, filed on Jan. 18, 2006, which is a continuation-in-part of application No. 11/306,307, filed on Dec. 22, 2005, which is a continuation-in-part of application No. 11/306,022, filed on Dec. 14, 2005, which is a continuation-in-part of application No. 11/164,391, filed on Nov. 21, 2005.

(51) Int. Cl.
*E21B 7/24* (2006.01)

(52) U.S. Cl. ..... 175/56; 175/389

(58) Field of Classification Search ..... 175/56, 175/385, 389, 381
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |

(Continued)

*Primary Examiner*—Hoang Dang
(74) *Attorney, Agent, or Firm*—Tyson J. Wilde

(57) ABSTRACT

In one aspect of the invention, a method for drilling a bore hole includes the steps of deploying a drill bit attached to a drill string in a well bore, the drill bit having an axial jack element with a distal end protruding beyond a working face of the drill bit; engaging the distal end of the jack element against the formation such that the formation applies a reaction force on the jack element while the drill string rotates; and applying a force on the jack element that opposes the reaction force such that the jack element vibrates and imposes a resonant frequency into the formation.

20 Claims, 12 Drawing Sheets

U.S. PATENT DOCUMENTS 1,360,908 A 11/1920 Everson
1,387,733 A 8/1921 Midgett
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,102,236 A * 12/1937 Johansen ..... 175/321
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,274,798 A * 9/1966 Wiggins, Jr. ..... 464/20
3,294,186 A 12/1966 Buell
3,301,339 A 1/1967 Pennebaker
3,303,899 A * 2/1967 Jones, Jr. et al. ..... 175/299
3,336,988 A * 8/1967 Jones, Jr. ..... 173/133
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,478,295 A * 10/1984 Evans ..... 175/56
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,388,649 A * 2/1995 Ilomaki ..... 175/27
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,864,058 A * 1/1999 Chen ..... 73/152.47
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,325,163 B2 * 12/2001 Tibbitts ..... 175/57
6,338,390 B1 * 1/2002 Tibbitts ..... 175/56
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
9,629,076 4/2005 Fanuel
6,953,096 B2 10/2005 Gledhill
2003/0213621 A1 11/2003 Britten
2004/0238221 A1 12/2004 Runia
2004/0256155 A1 12/2004 Kriesels

* cited by examiner

DRILLING AT A RESONANT FREQUENCY

CROSS REFERENCE TO RELATED APPLICATIONS

This Patent Application is a continuation-in-part of U.S. patent application Ser. No. 11/686,636 filed on Mar. 15, 2007 and entitled Rotary Valve for a Jack Hammer. U.S. patent application Ser. No. 11/686,636 is a continuation-in-part of U.S. patent application Ser. No. 11/680,997 filed on Mar. 1, 2007 now U.S. Pat. No. 7,419,016 and entitled Bi-center Drill Bit. U.S. patent application Ser. No. 11/680,997 is a continuation-in-part of U.S. patent application Ser. No. 11/673,872 filed on Feb. 12, 2007 now U.S. Pat. No. 7,484,576 and entitled Jack Element in Communication with an Electric Motor and/or generator. U.S. patent application Ser. No. 11/673,872 is a continuation-in-part of U.S. patent application Ser. No. 11/611,310 filed on Dec. 15, 2006 and which is entitled System for Steering a Drill String. This Patent Application is also a continuation-in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation-in-part of U.S. patent application Ser. No. 11/277,394 which filed on Mar. 24, 2006 and entitled Drill Bit Assembly with a Logging Device. U.S. patent application Ser. No. 11/277,394 filed Mar. 24, 2006, now U.S. Pat. No. 7,398,837 is a continuation-in-part of U.S. patent application Ser. No. 11/277,380 also filed on Mar. 24, 2006 and entitled A Drill Bit Assembly Adapted to Provide Power Downhole. U.S. patent application Ser. No. 11/277,380 is a continuation-in-part of U.S. patent application Ser. No. 11/306,976 which was filed on Jan. 18, 2006 and entitled "Drill Bit Assembly for Directional Drilling." U.S. patent application Ser. No. 11/306,976 is a continuation-in-part of Ser. No. 11/306,307 filed on Dec. 22, 2005, entitled Drill Bit Assembly with an Indenting Member. U.S. patent application Ser. No. 11/306,307 is a continuation-in-part of U.S. patent application Ser. No. 11/306,022 filed on Dec. 14, 2005, entitled Hydraulic Drill Bit Assembly. U.S. patent application Ser. No. 11/306,022 is a continuation-in-part of U.S. patent application Ser. No. 11/164,391 filed on Nov. 21, 2005, which is entitled Drill Bit Assembly. All of these applications are herein incorporated by reference in their entirety.

BACKGROUND OF THE INVENTION

This invention relates to the field of subterranean drilling. Typically, downhole hammers are used to affect periodic mechanical impacts upon a drill bit. Through this percussion, the drill string is able to more effectively apply drilling power to the formation, thus aiding penetration into the formation.

The prior art has addressed the operation of a downhole tool actuated by drilling fluid. Such issues have been addressed in the U.S. Pat. No. 4,979,577 to Walter, which is herein incorporated by reference for all that it contains. The '577 patent discloses a low pulsing apparatus that is adapted to be connected in a drill string above a drill bit. The apparatus includes a housing providing a passage for a flow of drilling fluid toward the bit. A valve which oscillates in the axial direction of the drill string periodically restricts the flow through the passage to create pulsations in the flow and a cyclical water hammer effect thereby to vibrate the housing and the drill bit during use. Drill bit induced longitudinal vibrations in the drill string can be used to generate the oscillation of the valve along the axis of the drill string to effect the periodic restriction of the flow or, in another form of the invention, a special valve and spring arrangement is used to help produce the desired oscillating action and the desired flow pulsing action.

BRIEF SUMMARY OF THE INVENTION

In one aspect of the invention, a method for drilling a bore hole includes the steps of deploying a drill bit attached to a drill string in a well bore, the drill bit having an axial jack element with a distal end protruding beyond a working face of the drill bit; engaging the distal end of the jack element against the formation such that the formation applies a reaction force on the jack element while the drill string rotates; and applying a force on the jack element that opposes the reaction force such that the jack element vibrates and causes the formation to vibrate at its resonant frequency which causes the formation to degrade. A spring force or a hydraulic force may vibrate the jack element, thus, vibrating the formation.

A motor or a piston may adjust the force on the jack element by compressing a spring of the spring mechanism. In some embodiments up to 15,000 lbs may be loaded to the jack element. In other embodiment, the spring force may be controlled hydraulically. In some embodiments, the jack element may be rotationally isolated from the drill string. A sensor disposed proximate the jack element may sense vibrations of the jack element and/or drill bit, so that the spring force may be adjusted as needed during the drilling process. The spring force may be adjusted to compensate for different hardnesses in the formation which will alter the reactive forces opposing the jack element.

The spring mechanism may comprise a compression spring, a tension spring, a coil spring, a Belleville spring, a gas spring, a wave spring, or combinations thereof. A stop disposed in the bore of the drill string may restrict the oscillations of the jack element. The stop may be a shelf formed in the bore or it may be an element inserted into the bore. In some embodiments, the spring mechanism comprises a second spring engaged with the jack element. A portion of the jack element may be disposed in a wear sleeve that has a hardness greater than 58 HRc.

At least one nozzle may be disposed within an opening of the working face of the drill bit and/or a portion of the nozzle may be disposed around the jack element. In some embodiments, the distal end of the jack element may comprise a pointed or blunt geometry. The distal end may be brazed to a carbide segment. The distal end may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof. Cutting elements disposed on the working face of the drill bit may contact the formation at negative or positive rake angles such that the formation being drilled may contribute to the vibrations of the drill string. The drill string may comprise a dampening system adapted to reduce top-hole vibrations. In some embodiments, the dampening system is located immediately above the drill bit. The dampening system may be located within 200 ft. from the drill bit.

DETAILED DESCRIPTION OF THE INVENTION AND THE PREFERRED EMBODIMENT

Figure 1:
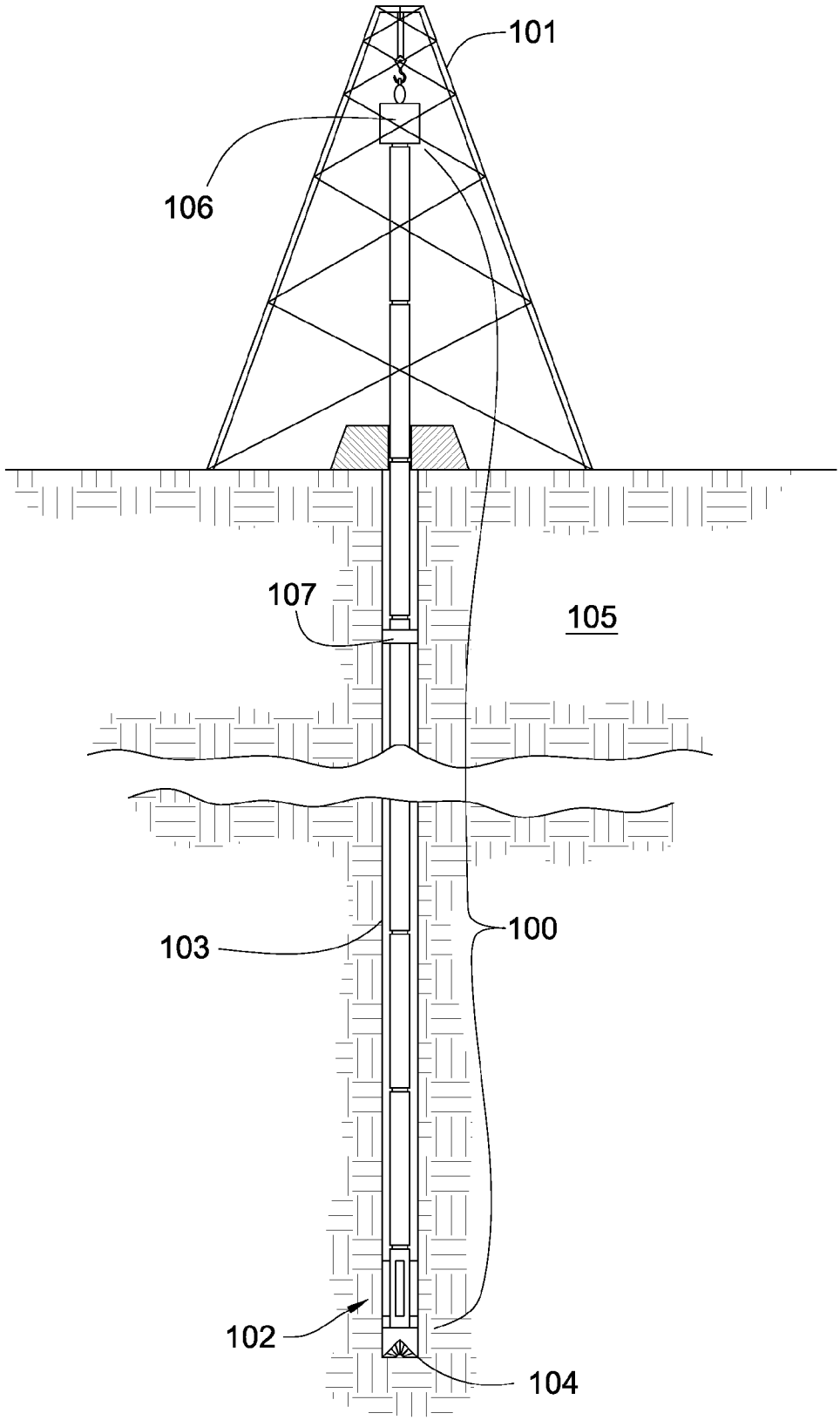
FIG. 1 is a perspective diagram of an embodiment of a drill string suspended in a bore hole

FIG. 1 shows a perspective diagram of a downhole drill string 100 suspended by a derrick 101. A bottom-hole assembly 102 is located at the bottom of a well bore 103 and comprises a drill bit 104. As the drill bit 104 rotates downhole the drill string 100 advances farther into the earth. The drill string 100 may penetrate soft or hard subterranean formations 105. The bottomhole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 to Hall which is herein incorporated by reference for all that it contains, discloses a telemetry system that may be compatible with the present invention; however, other forms of telemetry may also be compatible such as systems that include wired pipe, mud pulse systems, electromagnetic waves, radio waves, and/or short hop. In some embodiments, no telemetry system is incorporated into the drill string. In the preferred embodiment, a dampening system 107 may be disposed on the drill string 100 such that vibrations of the drill string 100 do not cause the surface equipment or supporting equipment to vibrate. The dampening system 107 may be located within 200 feet from the drill bit 104 so that the lower portion of the drill string 100 may vibrate and not affect the equipment above ground and/or the drill rig. In some embodiments, the dampening system may be located immediately above the drill bit. In other embodiments, it may be beneficial to use a portion of the tool string as a spring to help induce a resonant frequency into the formation 105.

Figure 2:
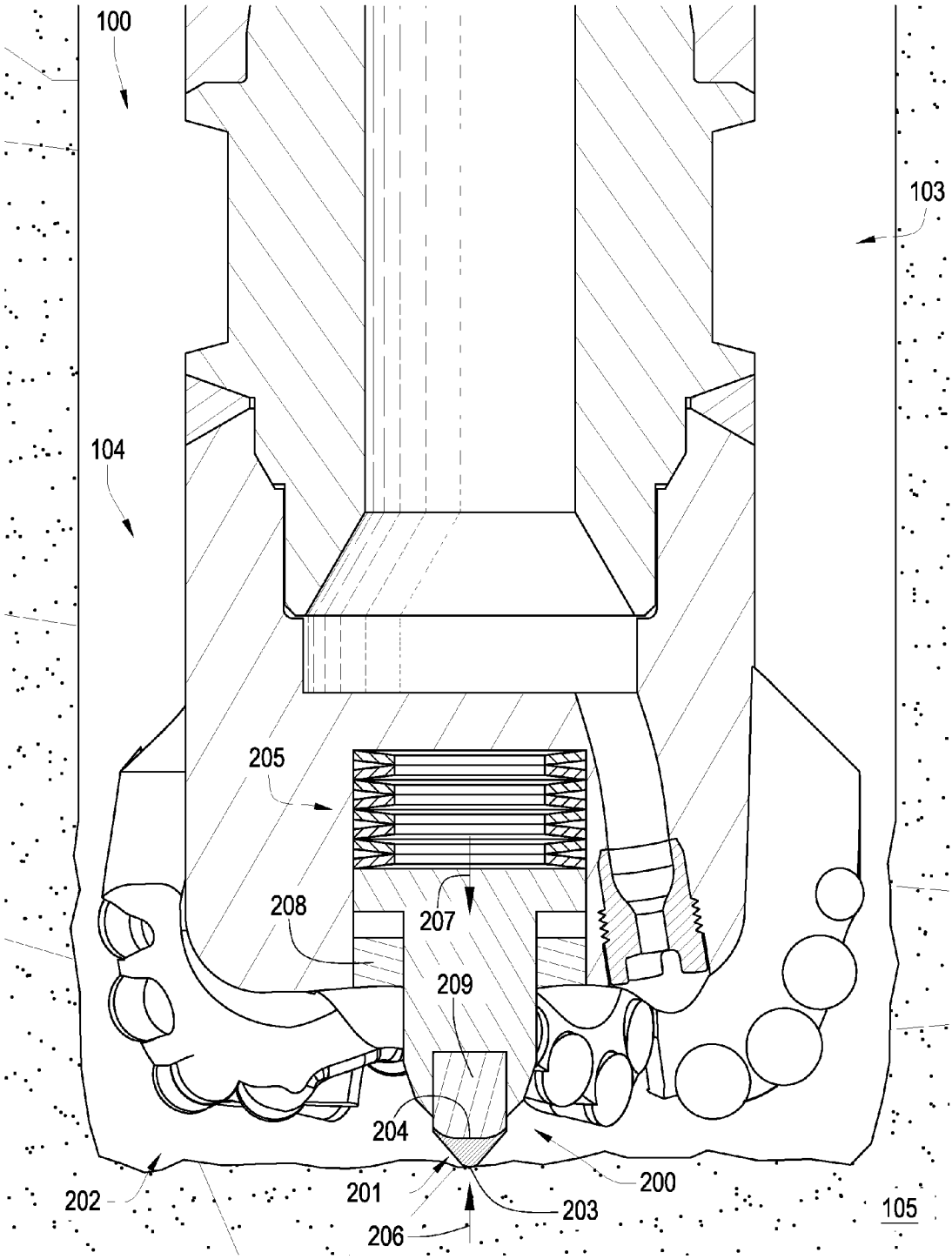
FIG. 2 is a cross-sectional diagram of an embodiment of a drill bit.

FIG. 2 is a cross-sectional diagram of a preferred embodiment of a drill bit 104. The drill bit 104 may be attached to a drill string 100 in a well bore 103. The drill bit 104 may have an axial jack element 200 with a distal end 201 protruding beyond a working face 202 of the drill bit 104. In this embodiment the distal end 201 may comprise a pointed, thick geometry. In other embodiments, the distal end may have a blunt geometry. More specifically, in this embodiment the distal end may have a substantially pointed geometry with a sharp apex 203 having a 0.050 to 0.125 inch radius. The distal end 201 may also have a 0.100 to 0.500 inch thickness from the apex 203 to a non-planar interface 204. The distal end 201 may comprise a superhard material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnate carbide, diamond impregnated matrix, silicon bounded diamond, and/or combinations thereof. The distal end 201 may be bonded to a carbide segment 209, which is press fit into a steel portion of the jack element.

The jack element 200 may also be attached to a spring mechanism 205. In this embodiment, the spring mechanism 205 comprises a Bellville spring. In other embodiments, the spring mechanism may comprise a compression spring, a tension spring, a coil spring, a gas spring, a wave spring, or combinations thereof. During a drilling operation, the distal end 201 may engage the formation 105 such that the formation 105 applies a reaction force in a direction, indicated by the arrow 206, on the jack element 200 while the drill string 100 rotates. A force in another direction, indicated by the arrow 207, may be applied on the jack element 200 that opposes the reaction force 206 such that the jack element vibrates. It is believed that by tuning the weight on bit (WOB) and the spring force of the spring mechanism with the reaction force imposed by the formation 105 that a resonant frequency of the formation may be produced causing the formation proximate the jack element to self destruct. The mechanical resonant frequency of the formation 105 may be the optimum working frequency. The WOB and the spring force may be approximately 15,000 lbs. The WOB may be adjusted depending on the hardness of the formation being drilled. It may be desired to vibrate the drill string 100 so that it vibrates at the resonant frequency of the formation 105. In some embodiments, the driller may know that the formation is vibrating at its resonant frequency because the rate of penetration (ROP) may be dramatically high. As the formation changes its hardness the ROP may drop and the drill may adjust the WOB until the ROP again increases dramatically. In other embodiments, downhole sensors and feed back loops may adjust and the spring force of the spring mechanism automatically to impose the resonant frequency. In other embodiments a telemetry system and/or an automatic feedback loop may communicate with surface equipment that automatically adjust the WOB or communicate with the driller to adjust the WOB. A portion of the jack element 200 may be disposed in a wear sleeve 208 having a hardness greater than 58 HRc.

Figure 3:
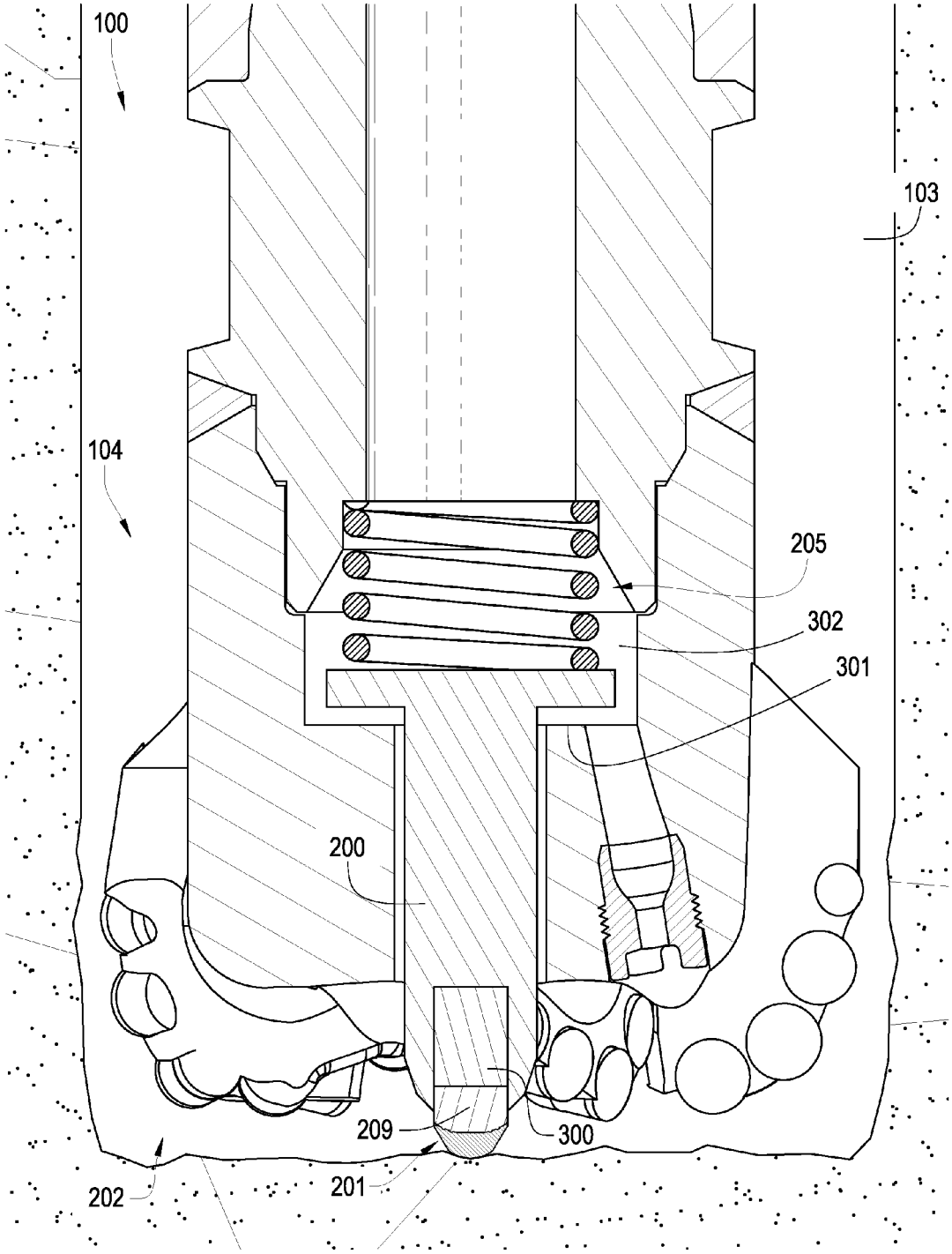
FIG. 3 is a cross-sectional diagram of another embodiment of a drill bit.

FIG. 3 is a cross-sectional diagram of another embodiment of a drill bit 104. In this embodiment, a drill bit 104 may be attached to a drill string 100 in a well bore 103. The drill bit 104 may have an axial jack element 200 with a distal end 201 protruding beyond a working face 202 of the drill bit 104. In this embodiment, the distal end 201 may have a blunt geometry. The distal end 201 may be bonded to a carbide segment 209. In this embodiment, carbide segment 209 may be brazed to another carbide segment 300, which is press fit into a steel portion of the jack element.

A reaction force may be applied by the formation 105 to the distal end of the jack element 200 and an opposing force, such as a WOB and the spring force, may be applied to the jack element from the drill string 100. In this embodiment, the spring mechanism 205 comprises a coil spring. As the drill string 100 rotates during operation, the jack element 200 may be rotationally isolated from the drill string 100. A stop 301, such as a shelf, may be disposed in a bore 302 of the drill string 100 to restrict the vibrations and/or travel of the jack element 200. The sharpness of the distal end of the jack element affects how much force is applied to the formation, thus in some embodiments, it may be advantageous to may a blunt geometry where in other embodiments, a sharper geometry may be more effective. In some embodiments, the distal end of the jack element may be asymmetric causing a drilling bias which may be used to steer the drill bit.

Figure 4:
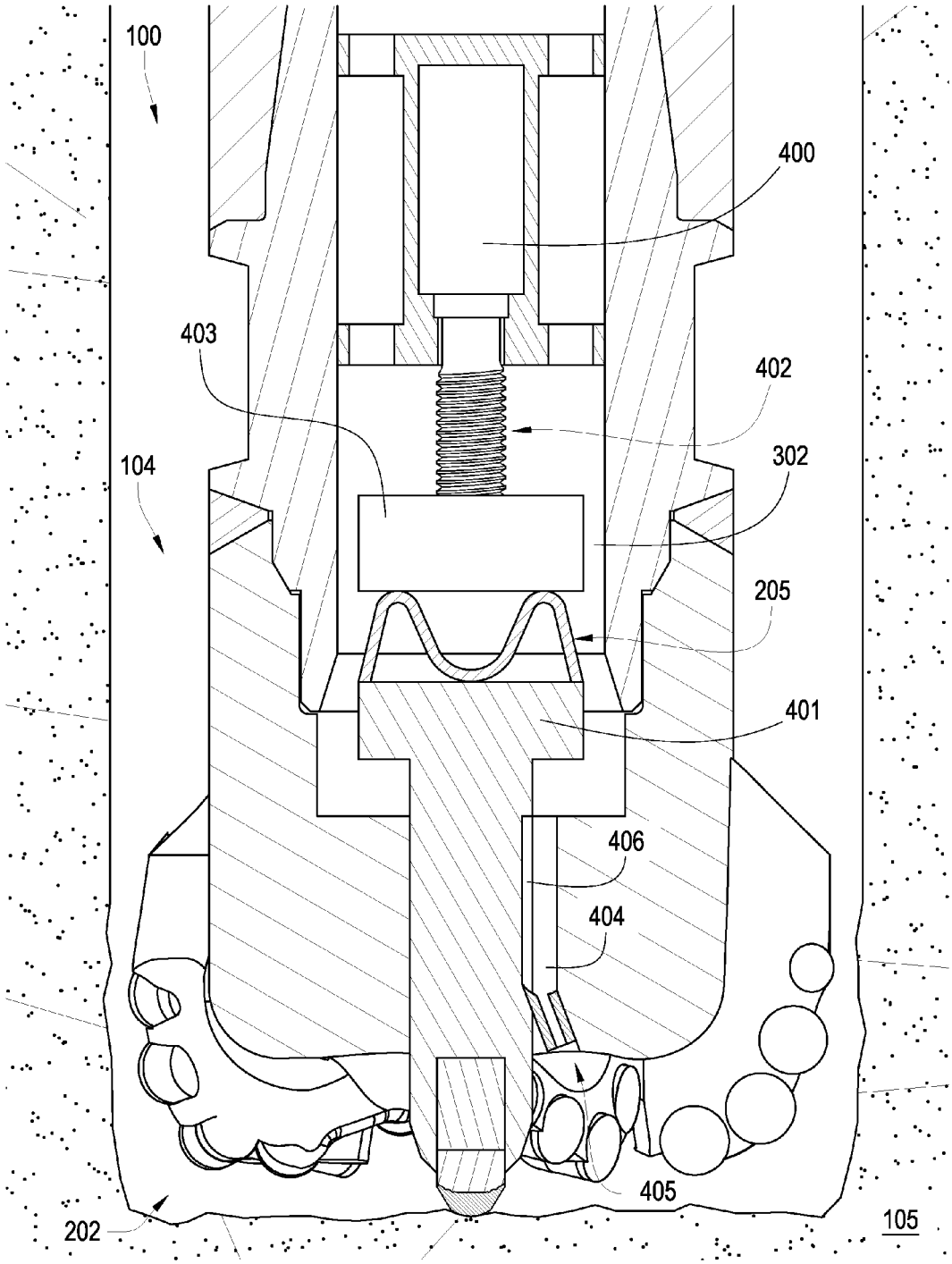
FIG. 4 is a cross-sectional diagram of another embodiment of a drill bit.

In the embodiment of FIG. 4, the spring mechanism comprises an electric motor 400 disposed in the bore 302 of the drill string 100 and is adapted to change the spring force. In this embodiment, the spring mechanism 205 comprises a wave spring. The jack element 200 may comprise a proximal end 401 with a larger diameter than the distal end 201 such that the proximal end 401 has a larger surface area to contact the wave spring. The electric motor may be adapted to rotate a threaded pin 402 thereby extending or retracting it with respect to the motor 400. The jack element 200 may also comprise an element 403 intermediate the threaded pin 402 and the spring 205. The intermediate element 403 may be attached to either the threaded pin 402 or the spring 205 such that as the threaded pin 402 rotates downward the spring 205 is compressed, exerting a greater downward force on the jack element 200. Alternatively, the motor may rotate in the opposite direction, relieving the compression on the spring and exerting a lesser downward force on the jack element 200. The hardness of the formation 105 may determine whether the motor 400 increases or decreases the spring force such that the distal end 201 of the jack element 200 vibrates at a frequency equal to that of the resonant frequency of the formation 105 being drilled.

At least one nozzle 404 may be disposed within an opening 405 of the working face 202 of the drill bit 104. A portion of the nozzle 404 may be disposed around the jack element 200. In this embodiment, the portion of the nozzle 404 may be disposed within an axial groove 406 in a side of the jack element 200. This may allow the nozzle 400 to be positioned closer to the jack element 200. The axial groove 406 may provide the shortest path for the fluid to exit from the bore 302 of the drill bit 104. The axial groove 406 may also have a geometry that angles the stream of fluid in a direction that is non-perpendicular to the working face 202 but that travels in a general direction of the junk slots.

Figure 5:
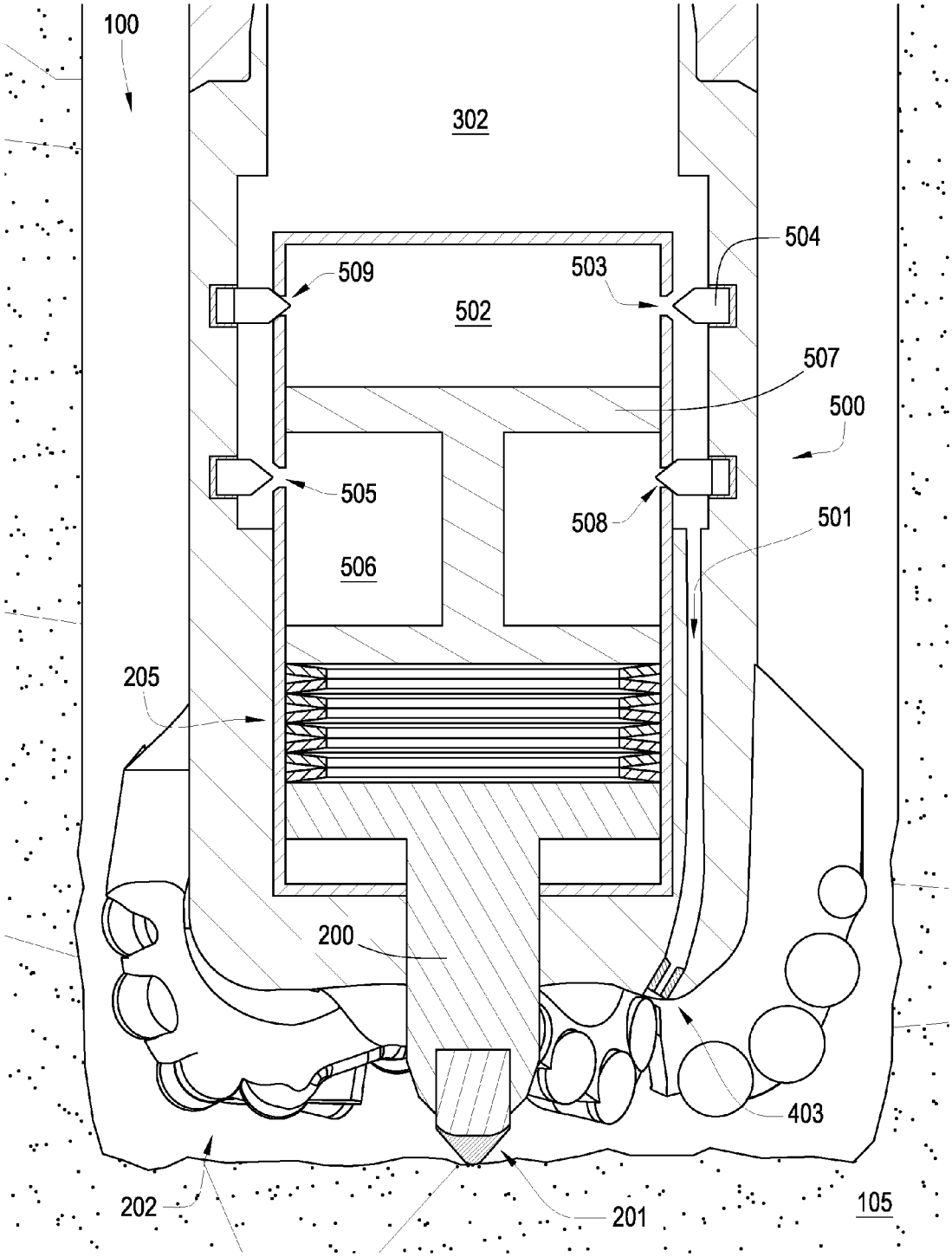
FIG. 5 is a cross-sectional diagram of another embodiment of a drill bit.

Referring now to FIG. 5, the spring mechanism 205 may comprise a hydraulic mechanism 500 to control the spring force. During a drilling operation a fluid channel 501 directs the drilling fluid from the bore 302 of the drill string 100 to at least one nozzle 403. Drilling fluid from the bore 302 may enter a first section 502 through a first aperture 503 formed in the piston mechanism 500 and exposed in the fluid channel 501. A first actuator 504 may be used to control the amount of drilling fluid allowed to enter the first section 502 by selectively opening or closing the first aperture 503. The first actuator 504 may comprise a latch, hydraulics, a magnetorheological fluid, electrorheological fluid, a magnet, a piezoelectric material, a magnetostrictive material, a piston, a sleeve, a spring, a solenoid, a ferromagnetic shape memory alloy, or combinations thereof. When the first aperture 503 is open, a second aperture 505 formed in a second section 506 of the hydraulic mechanism 500 may also be open. The second aperture 505 may be exposed in the fluid channel 501. As drilling fluid enters the first section 502, drilling fluid may be exhausted from the second section 506. Since the sections 502, 506 of the hydraulic mechanism 500 are divided by a separator 507 that keeps pressure from escaping from one section to another, the hydraulic mechanism 500 may move such that it engages the spring in communication with the jack element 200. Thus, the distal end 201 of the jack element 200 may extend beyond the working face 202 of the drill string 100. When the first and second apertures 503, 505 are closed, a third and fourth aperture 508, 509 may be opened; aperture 508 may pressurize the second section 506 and the aperture 509 may exhaust the first section 502. In this manner the spring may be extended. When all of the apertures 503, 505, 508, 509 are closed the spring may be held rigidly in place. Thus the equilibrium of the section pressures may be used to control the position of the spring. During a drilling operation, the distal end 201 of the jack element 200 may engage the formation 105, which will exert a formation pressure on the spring and change the pressure equilibrium and thereby change the position of the spring.

Figure 6:
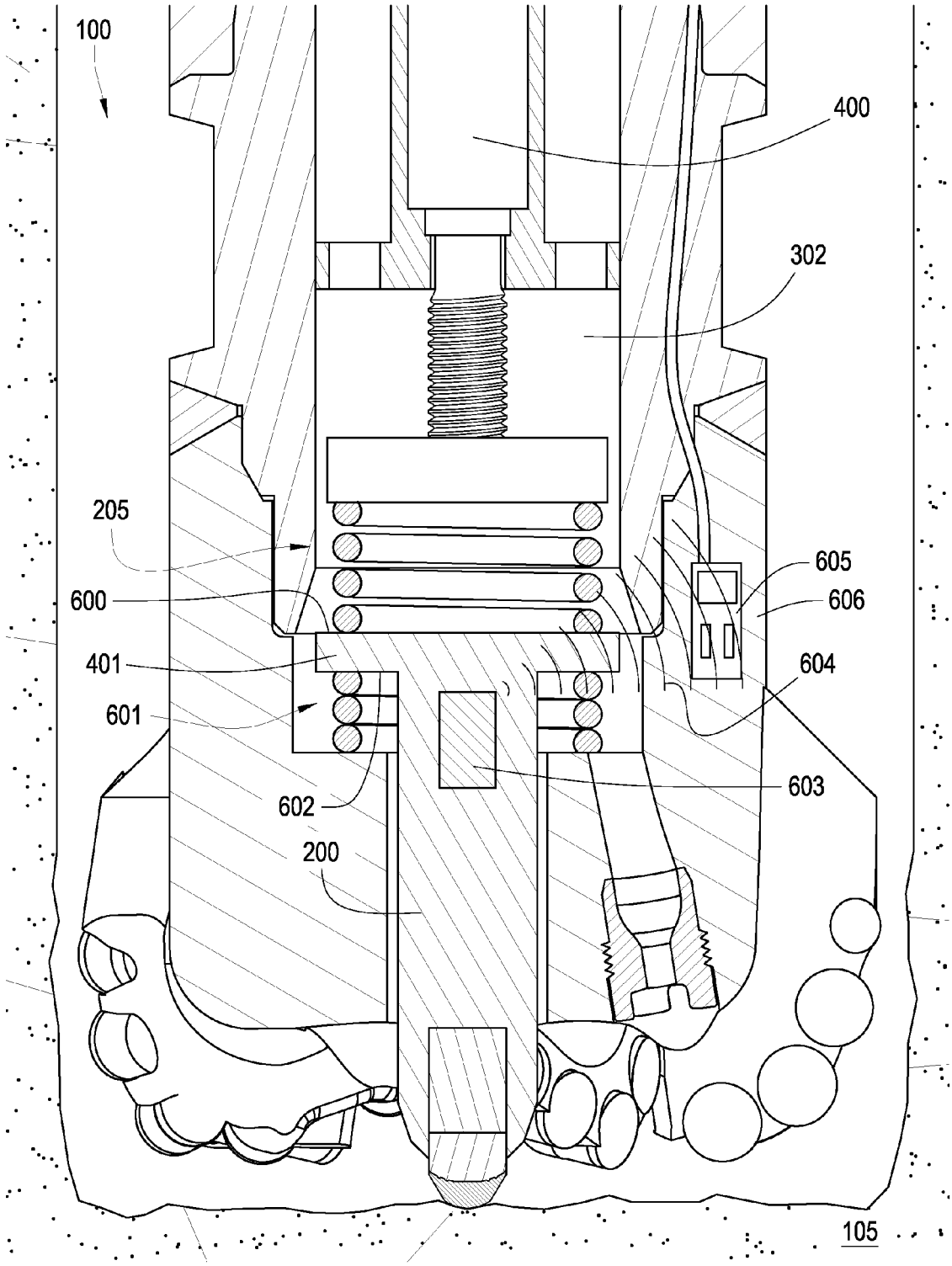
FIG. 6 is a cross-sectional diagram of another embodiment of a drill bit.

FIG. 6 shows a coil spring 205 in communication with a side 600 of the proximal end 401 of the jack element 200. Another spring 601 may contact the other side 602 of the proximal end 401 of the jack element 200 such that the jack element 200 may compress and/or relieve each spring as it oscillates.

A sensor 603 may be attached to the jack element 200. The sensor 603 may be a geophone, a hydrophone, a piezoelectric device, a magnetostrictive device, acceleratometer, or another vibration sensor. In some embodiments, the sensor 603 may receive acoustic reflections 604 produced by the movement of the jack element 200 as it oscillates or vibrates. Electrical circuitry 605 may be disposed within a wall 606 of the drill string 100. The electrical circuitry 605 may be adapted to measure and maintain the orientation of the drill string 100 with respect to the formation 105 being drilled. The electrical circuitry 605 may also control the motor 400, which in turn controls the compression of the spring.

Figure 7:
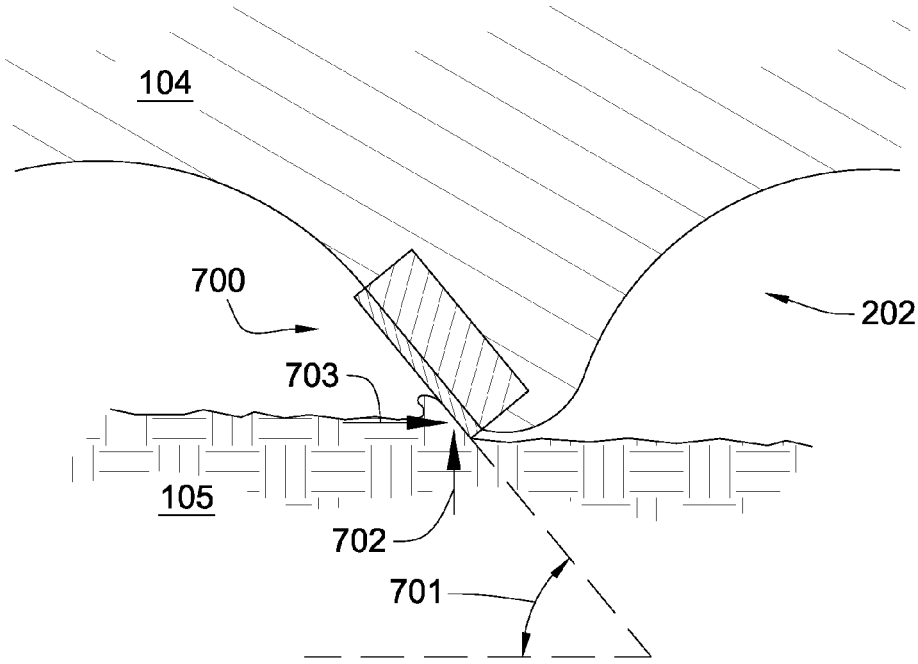
FIG. 7 is a cross-sectional diagram of an embodiment of a cutting element positioned on a drill bit.

FIG. 7 is a cross-sectional diagram of an embodiment of a cutting element 700 positioned on a working face 202 of a drill bit 104. The cutting element 700 may comprise a contact angle 701 such that the angle 701 is less than 90 degrees. During a drilling operation, the cutting element 700 may slide across a formation 105, such that the formation 105 exhibits a force in a direction, indicated by an arrow 702, against the drill bit 104 and a force in a direction, indicated by an arrow 703, also against the drill bit 104. These forces 702, 703 may help to vibrate the drill bit 104, which in turn vibrates the formation 105.

Figure 8:
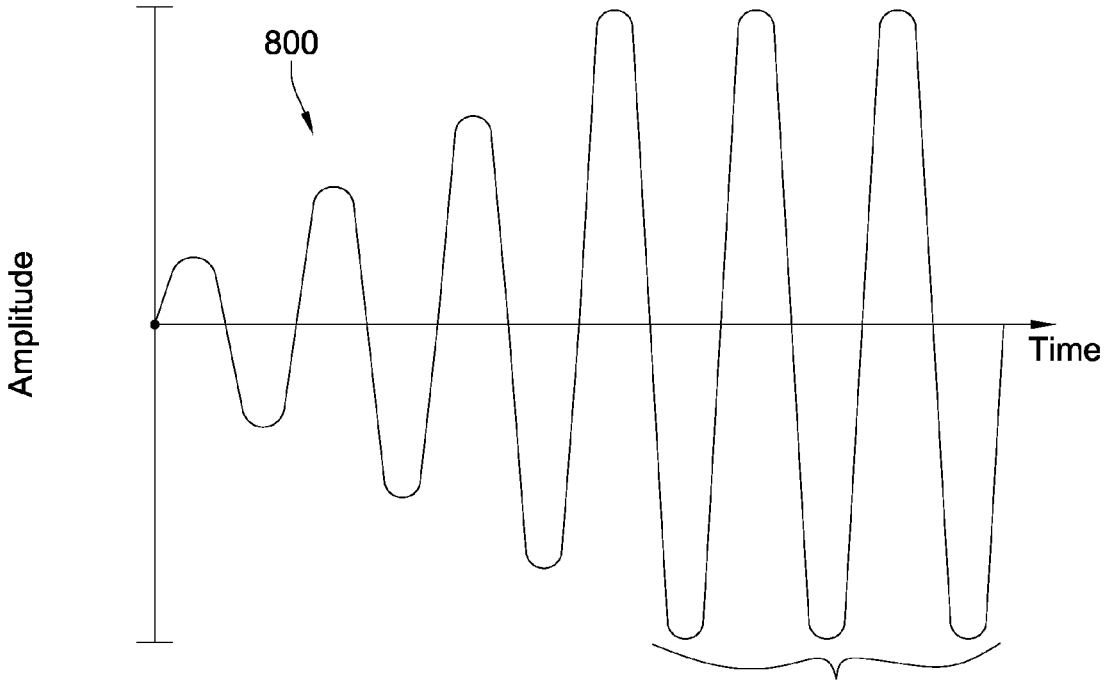
FIG. 8 is a graph that shows an embodiment of a frequency.
Figure 9:
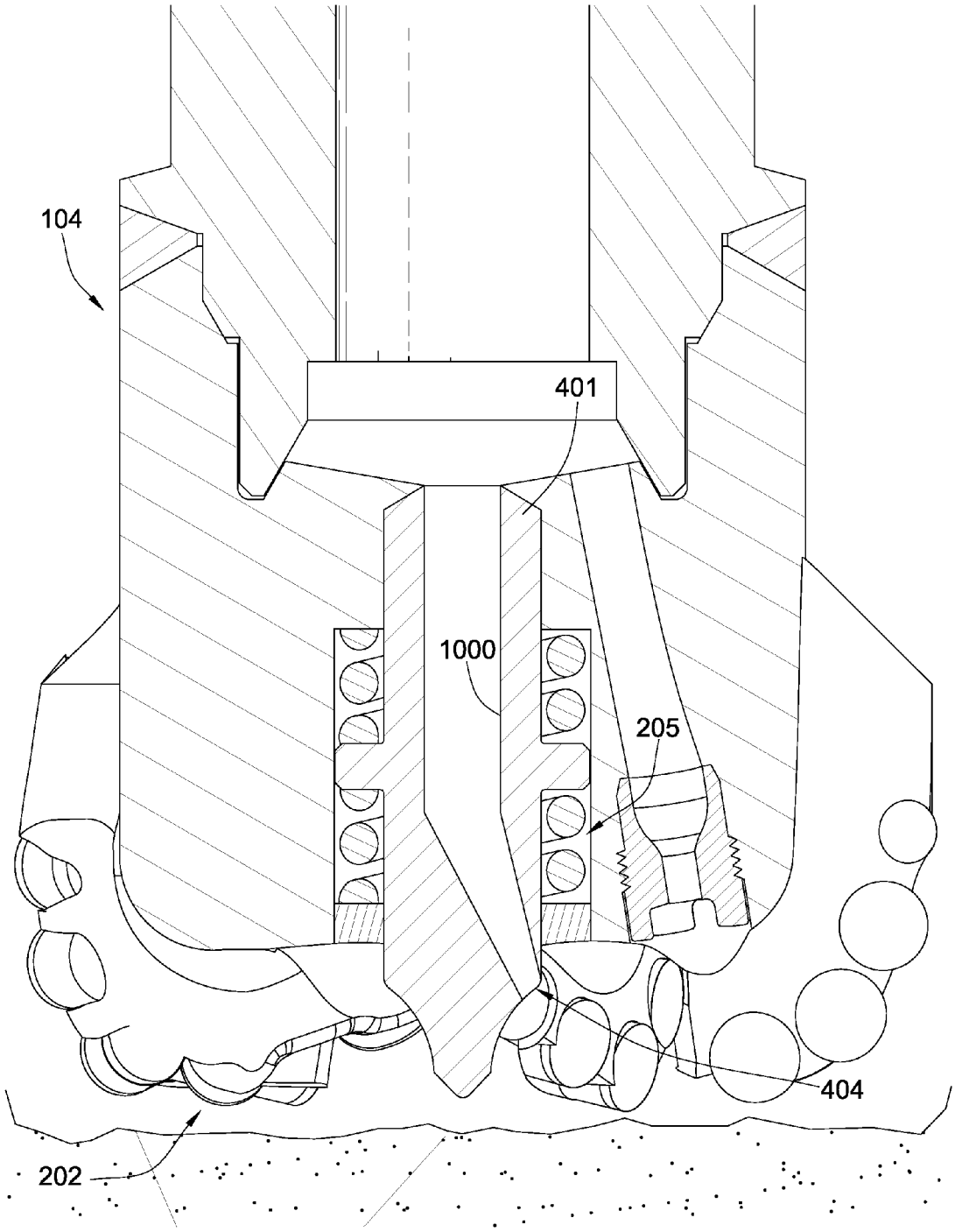
FIG. 9 is a cross-sectional diagram of another embodiment of a drill bit.

During a drilling operation a distal end of a jack element may oscillate against a formation, causing the formation to vibrate at some frequency. The formation may comprise a resonant or a natural frequency such that when the drill string vibrates the formation at this frequency, the ROP improves. The graph of FIG. 8 shows an embodiment of an amplitude of a frequency wave 800 over time. During a drilling operation, characteristics such as density and porosity of the formation may change over time. The graph shows the amplitude of the frequency wave 800 increasing to a maximum over time as the spring adjusts to the hardness of the formation. At the resonant frequency, the amplitude is at a maximum FIG. 9 is a cross-sectional diagram of an embodiment of a drill bit 104. At least a portion of a nozzle 404 may be disposed within the proximal end 401 of the jack element 200. A bore 1000 may be formed into the jack element 200 and drill bit 104 after the jack element 200 has been inserted into the working face 202. The bore may be lined with a hard material in order to protect the nozzle 404 from wear due to high pressures and velocities of the fluid passing through the nozzle 404. A spring mechanism 205 may comprise at least two springs engaged with the jack element 200. The jack element 200 may compress and/or relieve each spring as it oscillates.

Figure 10:
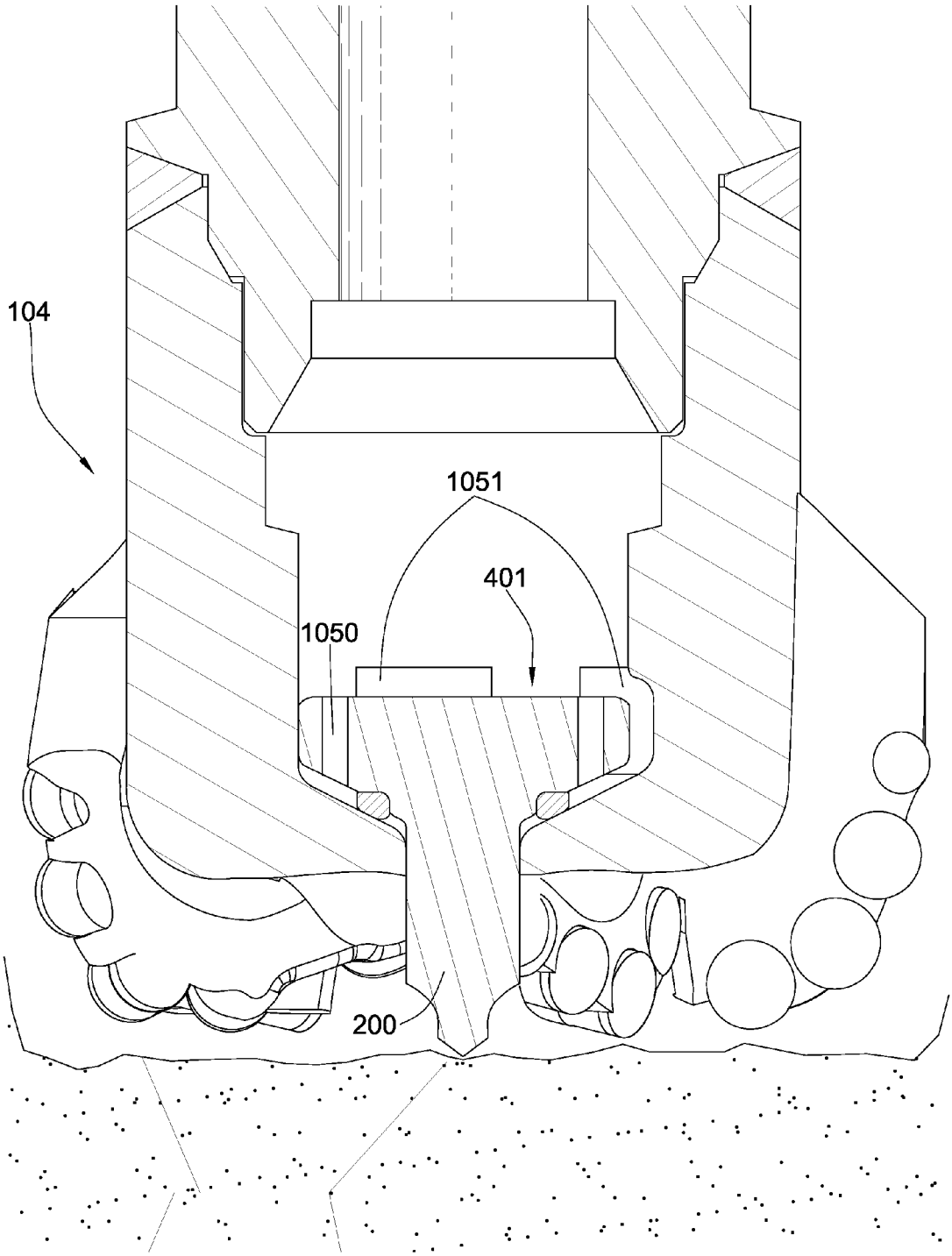
FIG. 10 is a cross-sectional diagram of another embodiment of a drill bit.

FIG. 10 is a cross sectional diagram of another embodiment. This embodiment does not require a spring mechanism. As fluid engages a proximal end of the jack element, the jack element is pushed towards the formation. Fluid pass-by passages allow flow through the proximal end of the jack element. More flow is allowed around the jack element once the proximal end reaches pockets formed in the bore of the drill bit. The extra flow will drop the pressure exerted on the proximal end and a reaction force pushing on the jack element by the formation may push the proximal end back from the pockets. A oscillation motion may then occur as the drilling fluid pressure is then increased, pushing the jack element towards the formation again until the pressure is relieved by the pockets.

Figure 11:
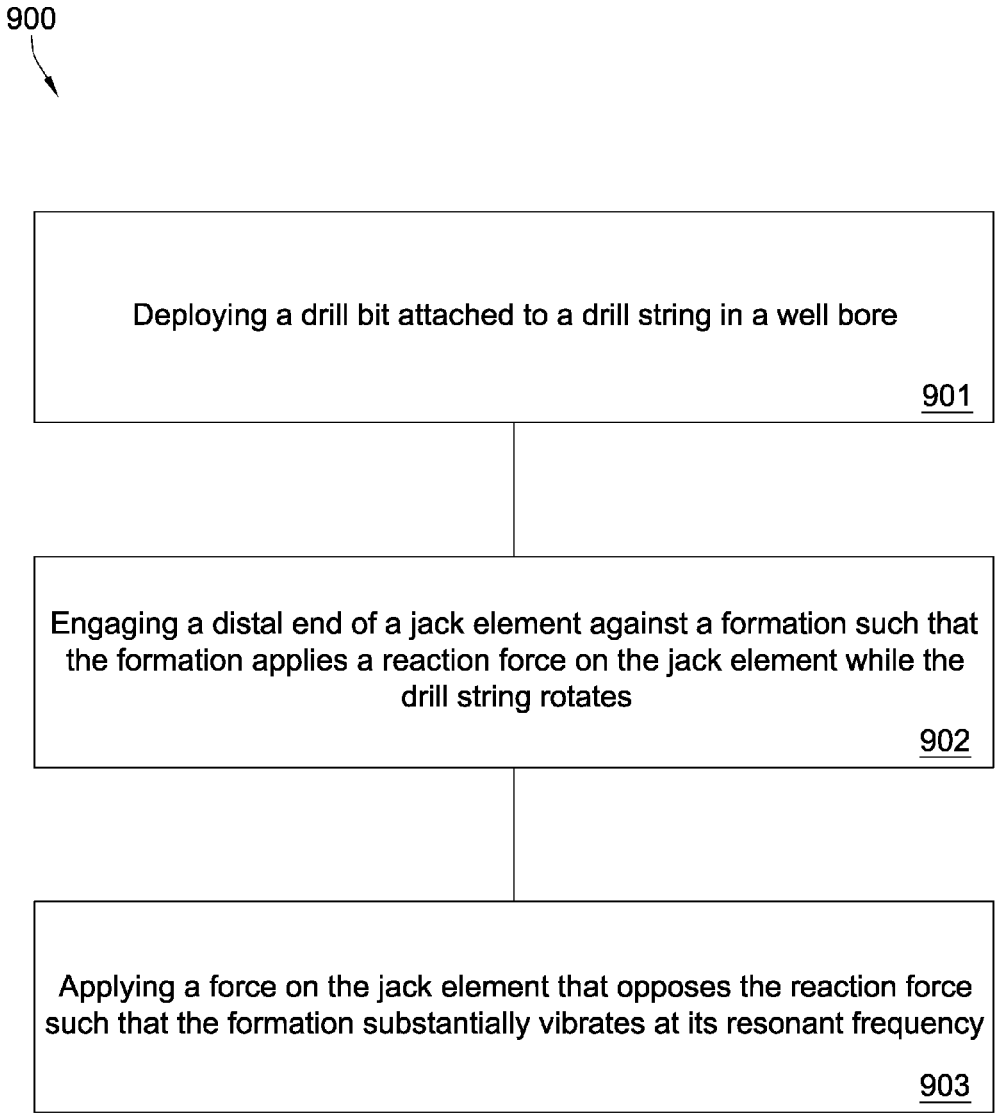
FIG. 11 is a diagram of an embodiment of a method for drilling a bore hole.

FIG. 11 is a diagram of an embodiment of a method 900 for drilling a bore hole. The method 900 includes deploying 901 a drill bit attached to a drill string in a well bore. The method also includes engaging 902 a distal end of a jack element against a formation such that the formation applies a reaction force on the jack element while the drill string rotates. Further the method 900 includes applying 903 a force on the jack element that opposes the reaction force such that the formation substantially vibrates at its resonant frequency. By vibrating the formation at its resonant frequency, the formation may more easily break up and thus, maximize the ROP.

FIGS. 12-17 disclose several asymmetric geometries that may be used with the present invention. It is believed that certain asymmetric geometries may have various advantages over other asymmetric geometries depending on the characteristics of the formation. Such characteristic may include hardness, formation pressure, temperature, salinity, pH, density, porosity, and elasticity. In some embodiments, all the geometries shown in FIGS. 12-17 may comprise superhard coatings although they are not shown.

Figure 12:
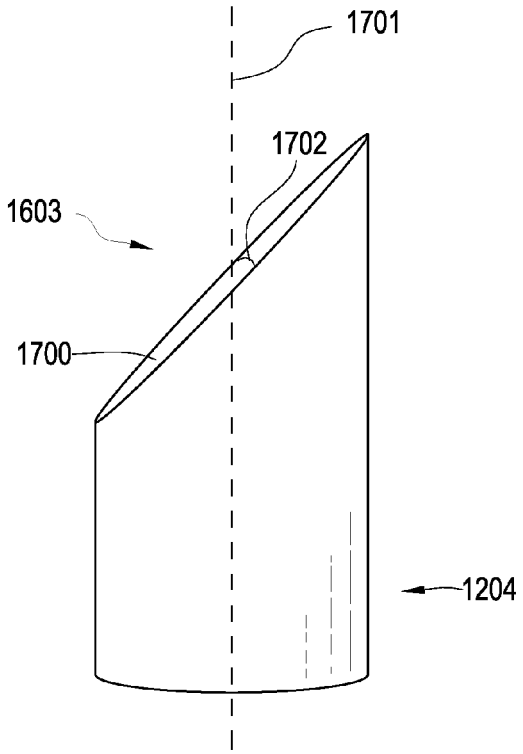
FIG. 12 is a perspective diagram of an embodiment of a distal end of a shaft.
Figure 13:
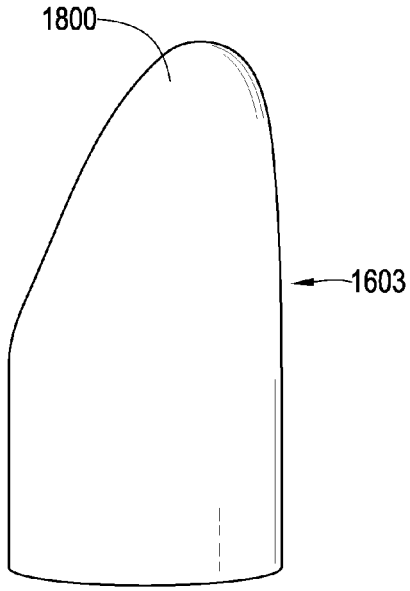
FIG. 13 is a perspective diagram of another embodiment of a distal end of a shaft.
Figure 14:
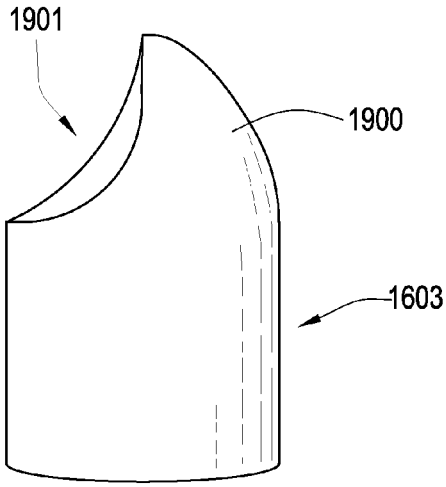
FIG. 14 is a perspective diagram of another embodiment of a distal end of a shaft.
Figure 15:
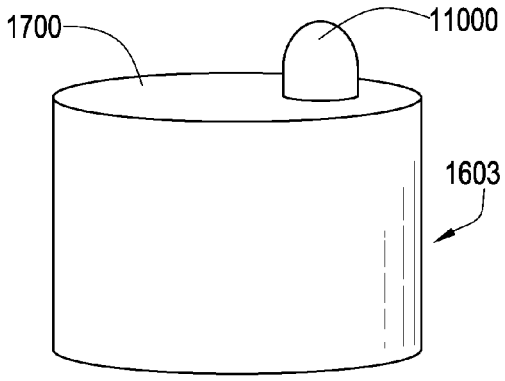
FIG. 15 is a perspective diagram of another embodiment of a distal end of a shaft.
Figure 16:
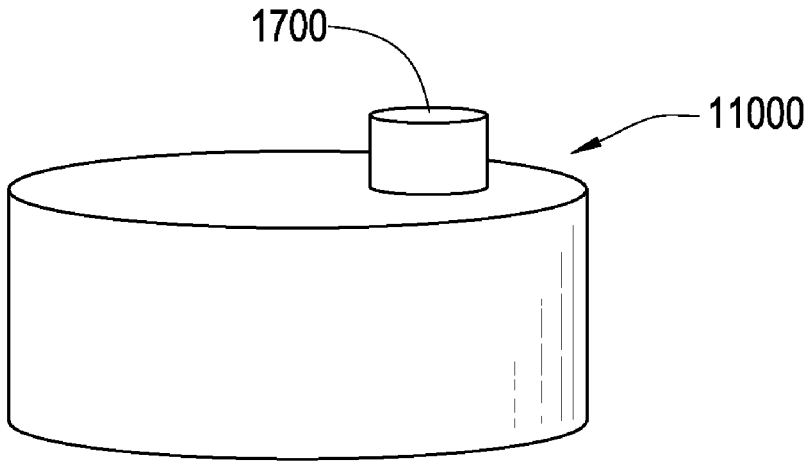
FIG. 16 is a perspective diagram of another embodiment of a distal end of a shaft.
Figure 17:
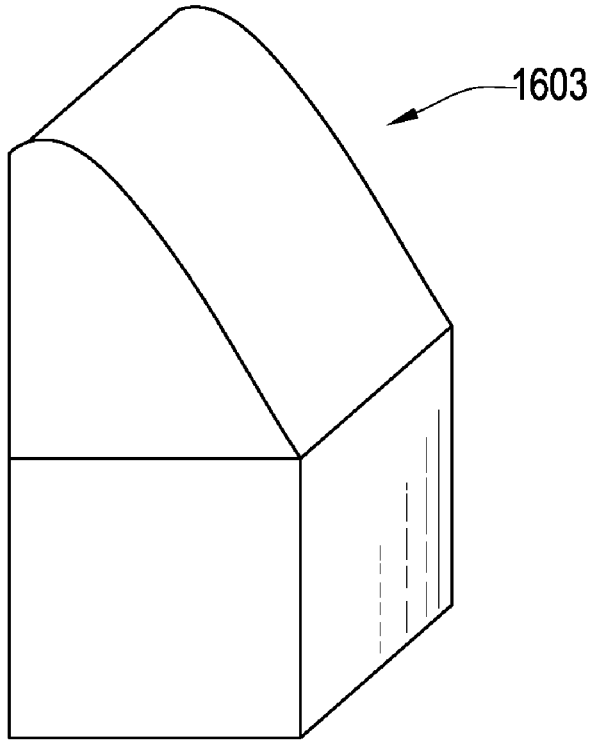
FIG. 17 is a perspective diagram of another embodiment of a distal end of a shaft.

FIG. 12 shows an asymmetric geometry 1603 with a substantially flat face 1700, the face 1700 intersecting a central axis 1701 of the shaft 1204 at an angle 1702 between 1 and 89 degrees. Ideally, the angle 1702 is within 30 to 60 degrees. FIG. 13 shows a geometry 603 of an offset cone 1800. FIG. 14 shows an asymmetric geometry 1603 of a cone 1900 comprising a cut 1901. The cut 1900 may be concave, convex, or flat. FIG. 15 shows a geometry 1603 of a flat face 1700 with an offset protrusion 11000. The embodiment of FIG. 16 shows an offset protrusion 11000 with a flat face 1700. The asymmetric geometry 1603 of FIG. 17 is generally triangular. In other embodiments, the asymmetric geometry 1603 may be generally pyramidal.

Whereas the present invention has been described in particular relation to the drawings attached hereto, it should be understood that other and further modifications apart fromthose shown or suggested herein, may be made within the scope and spirit of the present invention.

What is claimed is:

1. A method for drilling a bore hole, comprising the steps of:

deploying a drill bit attached to a drill string in a well bore, the drill bit comprising an axial jack element with an asymmetric distal end protruding beyond a working face of the drill bit;

engaging the distal end of the jack element against a formation such that the formation applies a reaction force on the jack element while the drill string rotates; and applying a force on the jack element that opposes the reaction force such that the jack element vibrates and causes the formation to vibrate and degrade that formation;

wherein the jack element is rotationally isolated from the drill bit.

2. The method of claim 1, wherein the force is a spring force or a hydraulic force.

3. The method of claim 2, wherein the spring force is adjusted by a spring mechanism comprising a compression spring, a tension spring, a coil spring, a Belleville spring, a gas spring, a wave spring, or combinations thereof.

4. The method of claim 3, wherein the spring mechanism comprises at least two springs engaged with the jack element.

5. The method of claim 2, wherein the spring force applies the force opposing the reactive force on the jack element.

6. The method of claim 2, wherein a motor or a piston adjusts the spring force on the jack element.

7. The method of claim 2, wherein the spring force is controlled hydraulically.

8. The method of claim 1, wherein approximately 15,000 lbs is loaded to the jack element.

9. The method of claim 1, wherein a sensor proximate the jack element senses downhole vibrations.

10. The method of claim 1, wherein a stop disposed in the bore of the drill string restricts the oscillations of the jack element.

11. The method of claim 1, wherein a portion of the jack element is disposed in a wear sleeve comprising a hardness greater than 58 HRc.

12. The method of claim 1, wherein a portion of a nozzle is disposed around the jack element.

13. The method of claim 1, wherein the distal end comprises a pointed geometry.

14. The method of claim 1, wherein the distal end comprises a blunt geometry.

15. The method of claim 1, wherein the distal end is brazed to a carbide segment.

16. The method of claim 1, wherein the distal end comprises a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

17. The method of claim 1, wherein cutting elements disposed on the working face of the drill bit contact the formation at negative or positive rake angles.

18. The method of claim 1, wherein the drill string comprises a dampening system disposed on the drill string adapted to restrict vibrations from reaching a drill rig.

19. The method of claim 1, wherein the jack element protrudes out of a recess formed in a working portion of the drill bit.

20. The method of claim 1, wherein the formation vibrates at a natural or resonant frequency.

* * * * *